US009068808B2

(12) United States Patent
Morgan et al.

(10) Patent No.: US 9,068,808 B2
(45) Date of Patent: Jun. 30, 2015

(54) AIR VEHICLE WITH BILATERAL STEERING THRUSTERS

(71) Applicant: Raytheon Company, Waltham, MA (US)

(72) Inventors: Robert W Morgan, Tucson, AZ (US); Eric J Borg, Tucson, AZ (US); Michael A Leal, Tucson, AZ (US); Adam D Nicholl, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 423 days.

(21) Appl. No.: 13/743,834

(22) Filed: Jan. 17, 2013

(65) Prior Publication Data

US 2014/0224921 A1 Aug. 14, 2014

(51) Int. Cl.

| | |
|---|---|
| ***F42B 10/66*** | (2006.01) |
| *F42B 10/00* | (2006.01) |
| *F42B 12/62* | (2006.01) |

(52) U.S. Cl.

CPC ..... *F42B 10/663* (2013.01); *F42B 12/62* (2013.01)

(58) Field of Classification Search

CPC ..... F42B 10/60; F42B 10/66; F42B 10/661; F42B 10/663; F42B 10/665; F42B 10/666; F42B 10/668; F42B 12/02; F42B 12/36; F42B 12/56; F42B 12/58; F42B 12/60; F42B 12/62

USPC ..... 244/3.1–3.3, 51, 52, 117 R, 137.1, 244/137.4, 158.1, 164, 169; 89/1.11; 91/47, 91/51; 60/200.1, 228, 229

See application file for complete search history.

(56) References Cited

U.S. PATENT DOCUMENTS

| | | | | | |
|---|---|---|---|---|---|
| 2,974,594 | A | * | 3/1961 | Boehm | 244/169 |
| 3,066,653 | A | * | 12/1962 | Shramo et al. | 91/51 |
| 3,612,442 | A | * | 10/1971 | Chisel | 244/3.22 |
| 3,788,069 | A | * | 1/1974 | Schmidt | 60/229 |
| 3,802,190 | A | * | 4/1974 | Kaufmann | 244/3.22 |
| 3,926,390 | A | * | 12/1975 | Teuber et al. | 244/3.22 |
| 4,408,735 | A | * | 10/1983 | Metz | 244/3.22 |
| 4,463,921 | A | * | 8/1984 | Metz | 244/3.22 |
| 4,482,107 | A | * | 11/1984 | Metz | 244/3.22 |

(Continued)

FOREIGN PATENT DOCUMENTS

| | | | | | |
|---|---|---|---|---|---|
| EP | 1843124 | A1 | * | 10/2007 | F02K 9/94 |
| FR | 2659734 | A1 | * | 9/1991 | F42B 10/66 |

(Continued)

*Primary Examiner* — Bernarr Gregory

(74) *Attorney, Agent, or Firm* — Renner, Otto, Boisselle & Sklar, LLP

(57) ABSTRACT

An air vehicle, such as a missile or a steerable submunition released from a missile or another air vehicle, has a bilateral thrust system for steering. The thrust system includes a pair of diametrically-opposed divert thrusters that provide thrust having radial components in opposite radial directions. In order to control the direction of thrust, the air vehicle controls rotation of the divert thrusters and/or timing of the firing of the thrusters. The air vehicle (or some part of the air vehicle that includes the divert thrusters) may be discretely rolled to position the divert thrusters to produce desired steering thrust. Alternatively, the air vehicle or part of the air vehicle may be continuously rolled, with the steering controlled by timing the thrust to the divert thrusters, such as by allocating thrust between the diametrically-opposed thrusters. Pressurized gas may be allocated between the two thrusters by use of pintle valve.

18 Claims, 3 Drawing Sheets

(56) References Cited

U.S. PATENT DOCUMENTS

| | | | | | |
|---|---|---|---|---|---|
| 4,531,693 | A * | 7/1985 | Raynaud et al. | 244/52 |
| 4,726,544 | A * | 2/1988 | Unterstein | 244/3.22 |
| 4,856,734 | A * | 8/1989 | Davies | 244/3.22 |
| 4,928,906 | A * | 5/1990 | Sturm | 244/3.22 |
| 4,955,558 | A * | 9/1990 | Machell et al. | 244/3.22 |
| 4,967,982 | A * | 11/1990 | Bagley | 244/3.22 |
| 5,016,836 | A * | 5/1991 | Thouron | 244/3.22 |
| 5,054,712 | A * | 10/1991 | Bar et al. | 244/3.22 |
| 5,062,593 | A * | 11/1991 | Goddard et al. | 244/169 |
| 5,074,492 | A * | 12/1991 | Morgand | 244/3.22 |
| 5,123,611 | A * | 6/1992 | Morgand | 244/3.22 |
| 5,238,204 | A * | 8/1993 | Metz | 244/3.15 |
| 5,456,425 | A * | 10/1995 | Morris et al. | 244/3.22 |
| 5,456,429 | A * | 10/1995 | Mayersak | 244/169 |
| 5,631,830 | A | 5/1997 | Schroeder | |
| 5,647,558 | A * | 7/1997 | Linick | 244/3.11 |
| 6,178,741 | B1 * | 1/2001 | Nelson et al. | 60/229 |
| 6,267,326 | B1 * | 7/2001 | Smith et al. | 244/3.22 |
| 6,289,669 | B1 * | 9/2001 | Smirra | 60/229 |
| 6,347,763 | B1 * | 2/2002 | Harkins et al. | 244/3.21 |
| 6,367,735 | B1 * | 4/2002 | Folsom et al. | 244/3.22 |
| 6,766,979 | B2 * | 7/2004 | Horwath | 244/3.17 |
| 6,817,569 | B1 * | 11/2004 | Horwath | 244/3.17 |
| 6,889,935 | B2 * | 5/2005 | O'Dwyer | 244/3.21 |
| 7,004,423 | B2 * | 2/2006 | Folsom et al. | 244/3.22 |
| 7,102,113 | B2 * | 9/2006 | Fujita et al. | 244/3.1 |
| 7,118,065 | B1 * | 10/2006 | Heitmann et al. | 244/3.22 |
| 7,791,006 | B2 | 9/2010 | Hasson et al. | |
| 7,891,298 | B2 * | 2/2011 | Minick et al. | 244/3.15 |
| 8,084,726 | B2 * | 12/2011 | Hanlon et al. | 244/3.22 |
| 8,226,042 | B1 * | 7/2012 | Howell et al. | 244/137.4 |
| 8,242,422 | B2 * | 8/2012 | Olden et al. | 244/3.1 |
| 8,338,768 | B2 * | 12/2012 | Hanlon et al. | 244/3.22 |
| 8,552,350 | B2 * | 10/2013 | Bielas et al. | 244/3.16 |
| 8,735,788 | B2 * | 5/2014 | Preston et al. | 244/3.22 |
| 8,800,913 | B2 * | 8/2014 | Pagliara et al. | 244/52 |
| 2003/0197088 | A1 * | 10/2003 | Folsom et al. | 244/3.22 |

FOREIGN PATENT DOCUMENTS

| | | | | |
|---|---|---|---|---|
| FR | 2980265 | A1 * | 3/2013 | F42B 10/66 |
| GB | 2316663 | A * | 3/1998 | F02K 9/80 |

* cited by examiner

AIR VEHICLE WITH BILATERAL STEERING THRUSTERS

BACKGROUND OF THE INVENTION

1. Field of the Invention

The invention is in the field of air vehicles, and systems and methods for steering air vehicles.

2. Description of the Related Art

Missiles and other air vehicles have used various steering methods and mechanism for course correction, such as when steering to intercept a target, for example an incoming weapon. Steering using vectored thrust and cruciform divert thrusters has been used. There is a continual need for improvement in such steering methods.

SUMMARY OF THE INVENTION

According to an aspect of the invention, an air vehicle includes a pair of diametrically-opposed bilateral thrusters that are used to steer the air vehicle.

According to another aspect of the invention, an air vehicle rotates, and radial thrust from diametrically-opposed divert thrusters is asymmetrically imposed for steering purposes, when the divert thrusters are arrange in a desired rotational orientation.

According to yet another aspect of the invention, an air vehicle includes: a thrust system that includes a pair of diametrically-opposed divert thrusters that provide thrust having radial components in opposite radial directions; a rotation system for rotating the divert thrusters circumferentially about a longitudinal axis of the air vehicle; and a control system operatively coupled to the thrust system and the rotation system. The control system controls the thrust system to provide thrust from the divert thrusters to provide steering thrust on the air vehicle, for steering the air vehicle.

According to still another aspect of the invention, a method of steering an air vehicle includes: rotating at least diametrically-opposed bilateral divert thrusters of the air vehicle about a longitudinal axis of the air vehicle; and varying thrust from the divert thrusters as a function of rotational position of the divert thrusters about the longitudinal axis, to provide thrust in a radial direction to steer the air vehicle.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

The annexed drawings, which are not necessarily to scale, show various aspects of the invention.

DETAILED DESCRIPTION

An air vehicle, such as a missile or a steerable submunition released from a missile or another air vehicle, has a bilateral thrust system for steering. The thrust system includes a pair of diametrically-opposed divert thrusters that provide thrust having radial components in opposite radial directions. In order to control the direction of thrust, the air vehicle controls rotation of the divert thrusters and/or timing of the firing of the thrusters. The air vehicle (or some part of the air vehicle that includes the divert thrusters) may be discretely rolled to position the divert thrusters to produce desired steering thrust. Alternatively, the air vehicle or part of the air vehicle may be continuously rolled, with the steering controlled by timing the thrust to the divert thrusters, such as by allocating thrust between the diametrically-opposed thrusters. Pressurized gas for the thrusters may be provided by burning solid fuel, and allocation of thrust between the two thrusters may be accomplished by use of pintle valve to control the relative allocation of pressurized gas between the two thrusters. The use of a bilateral divert thruster system allows reduction in weight, cost, and separate components, as well as simplifying control.

Figure 1:
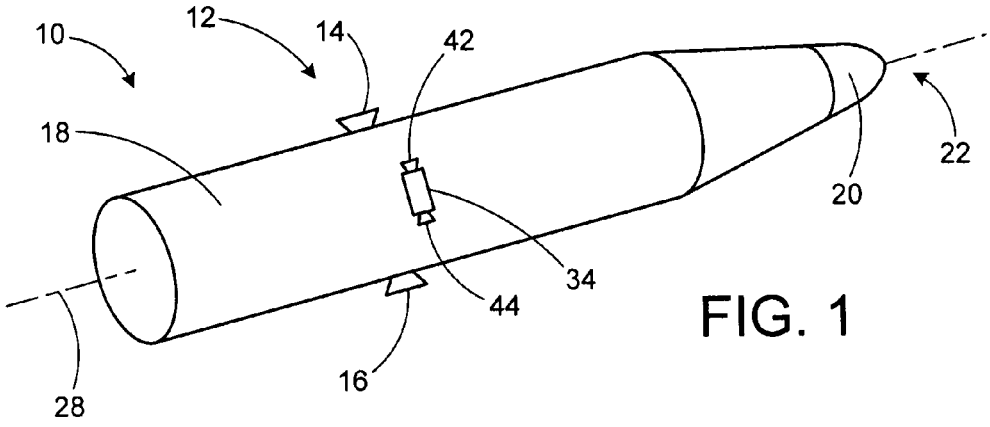
FIG. 1 is an oblique view of an air vehicle in accordance with an embodiment of the present invention.
Figure 2:
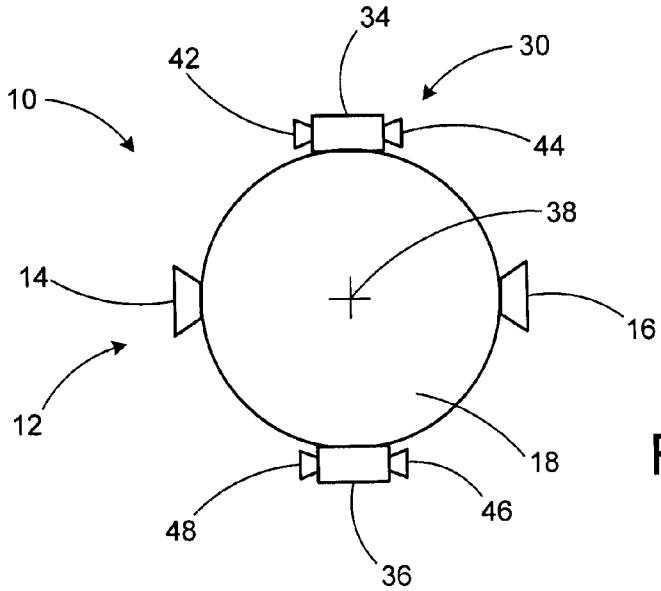
FIG. 2 is an end view of the air vehicle of FIG. 1.

FIGS. 1 and 2 show an air vehicle 10 that has a thrust system 12 for steering the air vehicle during flight. The air vehicle 10 may be a missile or may be a submunition, such as a kill vehicle that separates from a larger munition or missile, and then is independently guided to a target, for instance intercepting and colliding with a moving weapon or other target to destroy the moving target in a hit-to-kill function. The term "air vehicle" is meant to broadly include flying vehicles, even when used in space.

The thrust system 12 includes a pair of bilateral divert thrusters 14 and 16. The divert thrusters 14 and 16 are diametrically opposed on opposite sides of a fuselage 18 of the air vehicle 10, and expel pressurized gas in directions having radial components in opposite radial directions, to create thrust. The thrusters 14 and 16 may receive the pressurized gas from the same pressurized gas source, and may expel the pressurized gas through nozzles of the thrusters 14 and 16.

The divert thrusters 14 and 16 may be located at a longitudinal location along the fuselage 18 at or close to a center of mass of the air vehicle 10. This minimizes pitch of the air vehicle 10 due to firing of the divert thrusters 14 and 16.

The air vehicle 10 may also include a sensor or seeker 20 in a nose 22. The sensor 20 may be used in tracking a target, to provide information used in steering the air vehicle. The sensor 20 may be any of a variety of known types of sensors, such as optical sensors or radar sensors. The air vehicle 10 may also have the ability to detect its orientation, for example using inertial measurement units and/or roll sensing devices, utilizing sunlight or magnetism for example to keep track of the roll orientation of the air vehicle 10.

The air vehicle 10 may include a lethality enhancement device such as a warhead, a net, or a mechanism for increasing the effective impact area of the air vehicle 10. The lethality enhancement device may be used to increase the likelihood of the air vehicle 10 impacting a target in a hit-to-kill function.

The air vehicle 10 also includes a rotation system 30 that rotates at least the part of the air vehicle 10 that includes the divert thrusters 14 and 16. In the illustrated embodiment the rotation system 30 includes rotational thrusters 34 and 36 that are used to rotate the entire air vehicle 10 about its longitudinal axis 38. The rotational thrusters 34 and 36 supply thrust in a circumferential direction, rolling the air vehicle 10 in order to vary the location of the divert thrusters 14 and 16, to allow thrust to be applied in an appropriate radial direction to change the course of the air vehicle 10 as desired. The rotational thrusters 34 and 36 may be operated to produce continuous rotation (roll) of air vehicle 10, such as rotation about the longitudinal axis 38 at a steady angular rate (or continual rotation about the axis 38 at a non-constant rotation rate). Alternatively, the rotation thrusters 34 and 36 may be operated to provide discrete rotation of the air vehicle 10 for positioning the divert thrusters 14 and 16 to desired positions to provide desired thrust for steering. Both of these alternatives are discussed in greater detail below.

FIG. 2 shows details regarding one possible arrangement of the rotational thrusters 34 and 36. The rotational thruster 34 has a pair of nozzles 42 and 44 for providing thrust in opposite circumferential directions. The thruster 36, which is diametrically opposed to the rotational thruster 34, similarly has a pair of nozzles 46 and 48 for providing thrust in opposite circumferential directions. Each of the rotational thrusters 34 and 36 has a mechanism for controlling flow between the pair of nozzles for that thruster. Many suitable mechanisms are possible, including valves for controlling gas flow, separate controllable pressurized gas sources for the individual nozzles 42-48, and/or a pintle mechanism for controlling flow between the pair of nozzles for each of the rotational thrusters 34 and 36.

The air vehicle 10 (or part thereof) can be rotated about the axis 38 clockwise by ejecting pressurized gases from the nozzles 42 and 46. For counterclockwise acceleration the nozzles 44 and 48 are used. Pressurized gas for supplying rotational thrust may be supplied by one or more gas sources (not shown). The pressurized gas may be supplied by a pressurized gas source used by the divert thrusters 14 and 16, an example of which is described below, by separated dedicated pressurized gas source or sources, and/or by a pressurized gas source used to provide axial thrust to the air vehicle 10. The pressurized gas for the rotational thrusters 34 and 36 may be provided by burning of fuel, or by alternative sources, such as pressurized gas stored in one or more containers (not shown) within the fuselage 12. One or more valves (not shown) may be used to control flow of pressurized gas to the nozzles 42-48.

Other arrangements for the rotational thrusters 34 and 36 are possible. For example, the rotational thrusters 34 and 36 may only have one nozzle each, enabling rotational thrust in only a single direction. Control surfaces, such as fins, are another alternative for rotating the air vehicle 10, usable in situations where the air is sufficiently dense to generate lift for rotation.

Figure 3:
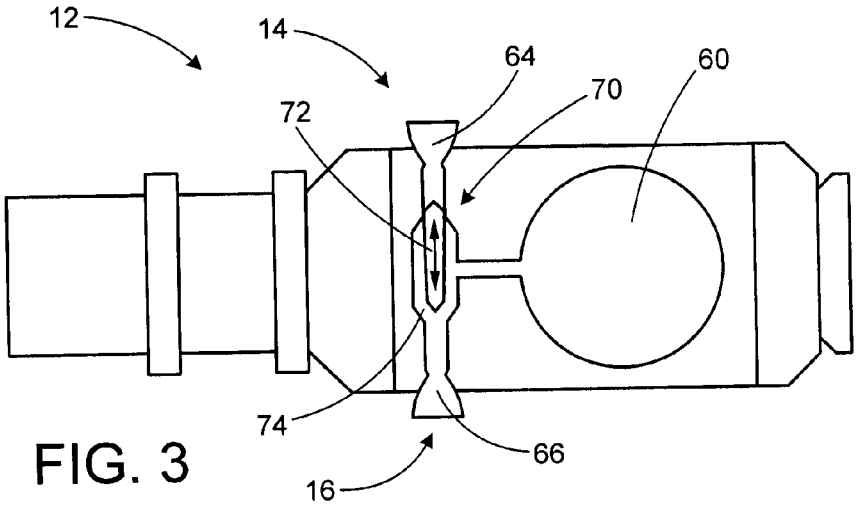
FIG. 3 is a side cutaway view illustrating one embodiment of the thrust system of the air vehicle of FIG. 1.

FIG. 3 shows one possible arrangement for supplying pressurized gas to the divert thrusters 14 and 16. A pressurized gas source or gas generator 60 provides pressurized gas to nozzles 64 and 66 of the divert thrusters 14 and 16, respectively. The gas generator 60 may generate gas through burning of a fuel, such as a solid rocket fuel. Alternatively liquid fuel may be used, although liquid fuel may require suitable valves to control flow of the fuel.

Flow of pressurized gasses from the gas generator is controlled by a pintle valve 70, with a pintle 72 able to translate back and forth within a cavity 74 to control the relative amounts of the pressurized gas that are directed to the nozzles 64 and 66 of the divert thrusters 14 and 16. In operation the gas generator 60 may continuously emit pressurized gas while it is operating. If no divert thrust is required, the pintle 72 is placed in a neutral, central position, sending equal amounts of pressurized gas out of each of the divert thruster nozzles 64 and 66. This produces no net force on the air vehicle 10. Translation of the pintle 72 up or down results in more gas being sent through one of the divert thrusters 14 and 16, producing a net thrust on the air vehicle 10 that steers the air vehicle 10.

Many alternative arrangements for providing pressurized gas are possible. However, the illustrated arrangement simplifies operation and reduces the complexity and number of parts. No shutoff valve is required if the gas generator 60 can continuously produce and expel pressurized gas during operation. The only moving part is the pintle 72. The position of the pintle 72 may be controlled by any of a number of suitable mechanisms, such as well-known mechanical or electromechanical mechanisms. In addition, pressurized gas from the gas source 60 may be used for other purposes, such as for forward thrust in an axial direction, or for rolling of the air vehicle by the rotation system 30.

Figure 4:
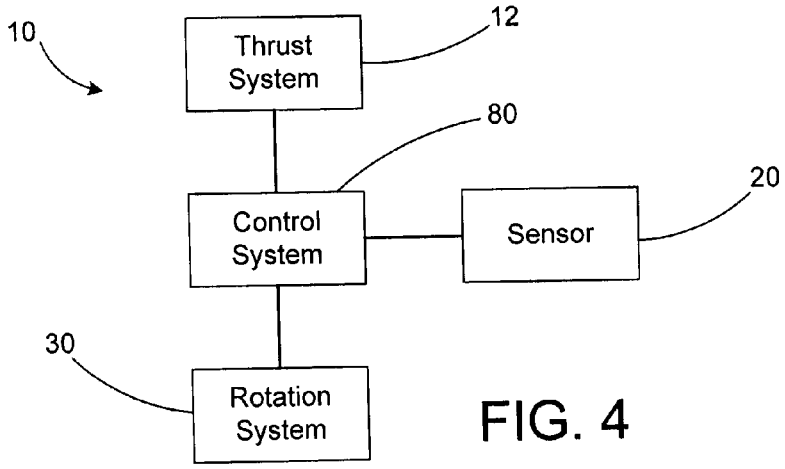
FIG. 4 is a block diagram illustrating control in operation of the air vehicle of FIG. 1.

FIG. 4 illustrates control of the air vehicle 10, with a control system 80 operatively coupled to the thrust system 12, the sensor 20, and the rotation system 30. The control system 80 controls the steering for the vehicle, receiving information from the sensor 20 for determining what sort of steering is necessary to guide the air vehicle 10 as desired to the target. The control system 80 controls use of the thrust system 12 and the rotation system 30 to change the course of the air vehicle 10 as necessary. The control system 80 can be used to control operation of the rotation system 30 and/or configuration and timing of operation of the thrust system 12. The control system 80. The control system 80 may be embodied in a suitable computer and/or one or more integrated circuits. It may be hardware and/or software.

One possible operation mode involves continuous rolling of air vehicle 10. In such an operation, once the rolling has been established, the control system 80 mainly controls the steering by controlling the timing of changes in the thrust output of the thrust system 12. Thrust from the bilateral thrusters 14 and 16 is suspended (or the thrust from each is made equal) except when the thrusters 14 and 16 are close to the position where one of the thrusters 14 and 16 is positioned in the circumferential position such that thrust would be in the desired direction for steering. At that point pressurized gas may be preferentially directed to the appropriate of the divert thrusters 14 and 16. As the air vehicle 10 rotates the divert thrusters 14 and 16 alternate which provides the steering thrust, as the thrusters 14 and 16 alternately get into the position to provide the steering thrust. The control of the thrust system 12 by the control system 80 takes into account time lags in the system, such as a time lag between sending signals to the thrust system 12 and changes in thrust from the divert thrusters 14 and 16. This mode of operation has the advantage of requiring little in the way of operation of the rotation system 30; once the rotation of the air vehicle 10 (or part of the air vehicle 10) is set up, no further actuation of the rotation system 30 is necessary. The roll rate may be about 1-10 Hz, for example.

An alternative operation mode involves only rotating the air vehicle 10 as needed to position the divert thrusters 14 and 16 properly for steering. In this sort of operation the control system 80 controls the operation of the rotation system 30 to position the air vehicle 10 such that one of the divert thrusters 14 and 16 is in a position to deliver divert thrust in a desired direction for steering the air vehicle 10. After positioning of the divert thrusters 14 and 16 the control system 80 is used to preferentially direct pressurized gas to the divert thruster that is in a position to deliver the steering thrust. The control system 80 therefore controls operation of the rotation system, and the timing of the firing of the thrust system 12. The control may take into account time lags in various parts of the system.

Figure 5:
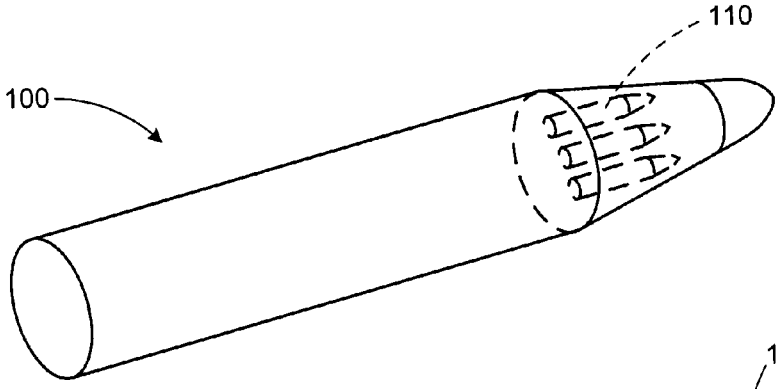
FIG. 5 is an oblique view of a munition that includes the air vehicle of FIG. 1.
Figure 6:
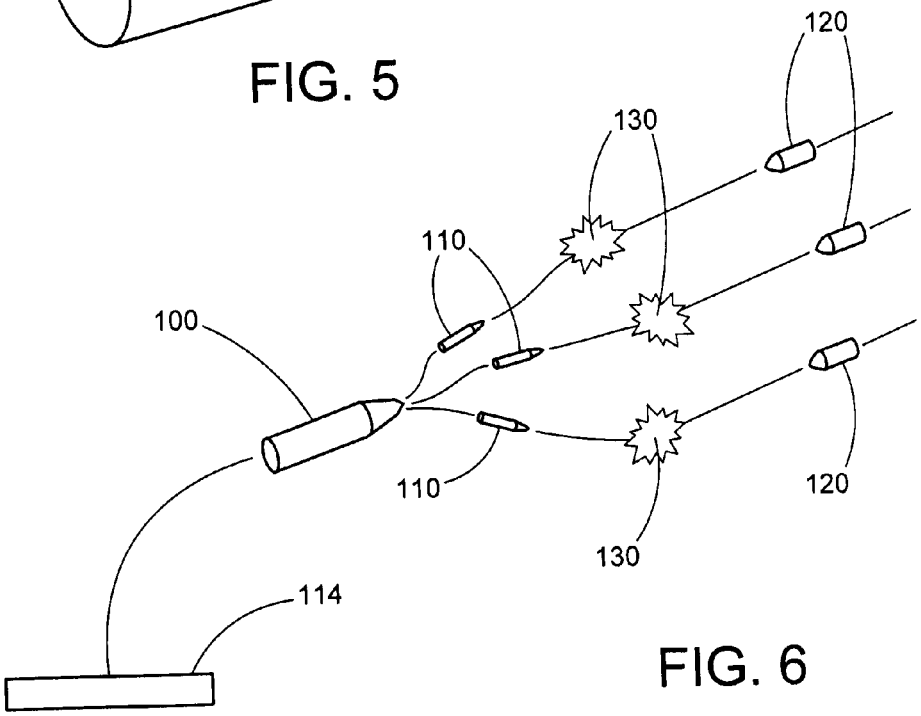
FIG. 6 is a diagram illustrating operation of the munition of FIG. 5.

FIG. 5 shows a munition 100 that the air vehicle 10 may be a part of. The munition 100 includes multiple independently-guidable submunitions 110, which may be identical to each other and to the air vehicle 10 described above. With reference to FIG. 6, the munition 100 may be launched from a launcher 114 on land, sea, or air. The submunitions 110 may be released after reaching the vicinity of multiple targets 120, for example missiles to be intercepted. The release of the submunitions 110 may occur at high altitude, for example at an altitude of 30-80 km or greater, where steering using control surfaces may be difficult due to the low air density. After release, the submunitions 110 may be independently steered, as described above, so as to collide with and neutralize the targets at collision locations 130.

Figure 7:
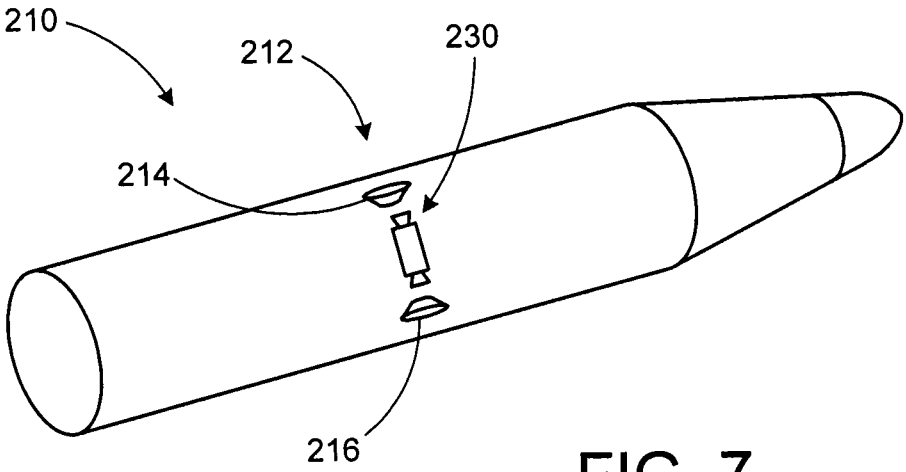
FIG. 7 is an oblique view of an air vehicle in accordance with an alternate embodiment of the present invention.
Figure 8:
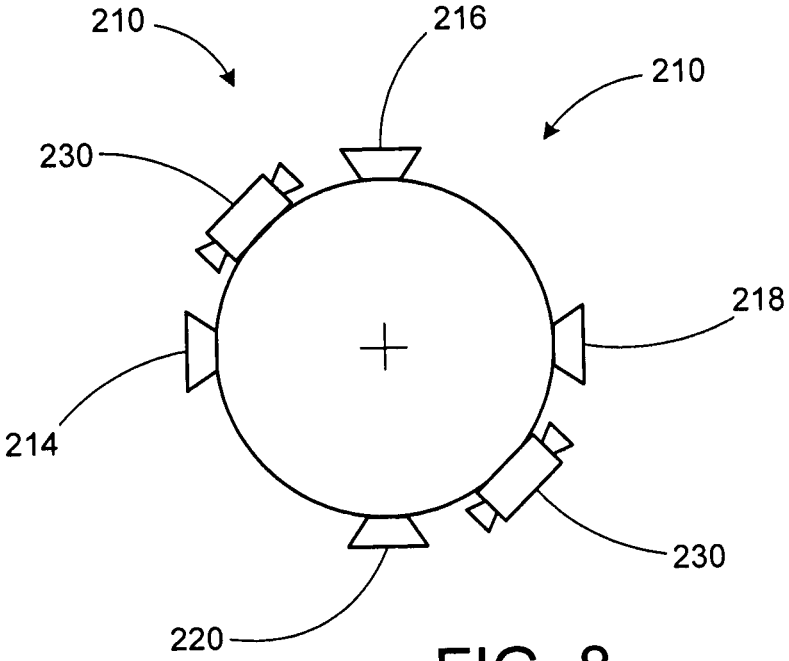
FIG. 8 is an end view of the air vehicle of FIG. 7.

FIGS. 7 and 8 shows an alternative thruster arrangement, in which an air vehicle 210 has a thrust system 212 with four divert thrusters 214, 216, 218, and 220 in a cruciform arrangement. The air vehicle 210 also has a rotation system 230 similar to the rotation system 30 (FIG. 1). In normal operation of the air vehicle 210 the rotation system 230 is not necessary for steering, since a combination of thrust from multiple of the divert thrusters 214-220 can be used to produce thrust on the air vehicle 210 in any desired direction. However if one of the thrusters 214-220 fails, this failure can be detected, and the air vehicle 210 then may be operated using the two remaining diametrically-opposed divert thrusters. The remaining diametrically-opposed thrusters may be operated as bilateral divert thrusters, using any of the methods described above (continuous rolling or discrete rolling). Thus bilateral thruster operation may be a back-up mode for a cruciform divert thruster system.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An air vehicle comprising:

a thrust system that includes a pair of diametrically-opposed divert thrusters that provide thrust having radial components in opposite radial directions;

a rotation system for rotating the divert thrusters circumferentially about a longitudinal axis of the air vehicle; and a control system operatively coupled to the thrust system and the rotation system;

wherein the thrust system includes a pressurized gas source that provides continuous flow of pressurized gas, and a valve that apportions the continuous flow between the divert thrusters; and wherein the control system controls the thrust system to provide thrust from the divert thrusters to provide steering thrust on the air vehicle, for steering the air vehicle.

2. The air vehicle of claim 1, wherein the valve is a pintle valve; and wherein the pintle valve includes a pintle that translates within a cavity in the valve to apportion the flow of pressurized gas between the divert thrusters.

3. The air vehicle of claim 1, wherein the pressurized gas source is a solid fuel motor.

4. The air vehicle of claim 1, wherein the rotational system includes a pair of rotational thrusters that provide thrust in a circumferential direction.

5. The air vehicle of claim 4, wherein the rotational thrusters each include a pair of nozzles for providing rotational thrust in opposite circumferential directions.

6. The air vehicle of claim 1, wherein the rotational system rotates the entire air vehicle about the longitudinal axis.

7. The air vehicle of claim 1, further comprising a target-tracking sensor operatively coupled to the control system.

8. The air vehicle of claim 1, wherein the control system controls positioning of the divert thrusters, using the rotational system.

9. The air vehicle of claim 1, wherein the control system controls timing of thrust from the divert thrusters.

10. The air vehicle of claim 9, wherein the rotational system continuously rotates at least the divert thrusters around the longitudinal axis during the steering.

11. The air vehicle of claim 1, wherein the air vehicle is an interceptor missile.

12. The air vehicle of claim 11, wherein the interceptor missile is a submunition that is part of a munition that includes other independently-steerable submunitions.

13. A method of steering an air vehicle comprising:

rotating at least diametrically-opposed bilateral divert thrusters of the air vehicle about a longitudinal axis of the air vehicle; and varying thrust from the divert thrusters as a function of rotational position of the divert thrusters about the longitudinal axis, to provide thrust in a radial direction to steer the air vehicle;

wherein the varying thrust includes changing apportionment of thrust between the divert thrusters.

14. The method of claim 13, wherein the rotating includes rotating substantially all of the air vehicle about the longitudinal axis.

15. The method of claim 13, wherein the rotating includes continuously rotating the divert thrusters; and wherein the varying thrust includes periodically varying the thrust, during the continuously rotating of the divert thrusters.

16. The method of claim 13, wherein the rotating includes discretely rotating at least the bilateral thrusters; and after positioning the divert thrusters with the discretely rotating, varying the thrust from the divert thrusters.

17. The method of claim 13, wherein the thrusters are coupled to a pressurized gas source that provides continuous flow of pressurized gas throughout the steering.

18. The method of claim 13, wherein the rotating and the varying thrust are controlled by a control system of the air vehicle.

* * * * *